US007194827B2

(12) United States Patent
Mercer et al.

(10) Patent No.: US 7,194,827 B2
(45) Date of Patent: Mar. 27, 2007

(54) SNOW THROWER DISCHARGE CHUTE

(75) Inventors: Tim Mercer, Green Bay, WI (US); Scott Deschler, Kaukauna, WI (US); John Adrian, Oshkosh, WI (US)

(73) Assignee: Ariens Company, Brillion, WI (US)

( * ) Notice: Subject to any disclaimer, the term of this patent is extended or adjusted under 35 U.S.C. 154(b) by 245 days.

(21) Appl. No.: 10/973,155

(22) Filed: Oct. 26, 2004

(65) Prior Publication Data

US 2006/0096134 A1 May 11, 2006

(51) Int. Cl.
*E01H 5/09* (2006.01)

(52) U.S. Cl. ..... 37/260; 37/261

(58) Field of Classification Search ..... 37/260, 37/261, 257

See application file for complete search history.

(56) References Cited

U.S. PATENT DOCUMENTS

| | | | | |
|---|---|---|---|---|
| 2,200,623 A | | 5/1940 | James | |
| 2,642,680 A | | 6/1953 | Curtis et al. | |
| 3,075,813 A | | 1/1963 | Vohl | |
| 3,313,386 A | * | 4/1967 | Schwalm | 193/22 |
| 3,466,767 A | | 9/1969 | Rubin | |
| 3,468,041 A | | 9/1969 | Mattson et al. | |
| 3,570,641 A | * | 3/1971 | Lefeuvre et al. | 193/4 |
| 3,580,351 A | | 5/1971 | Mollen | |
| 3,742,626 A | * | 7/1973 | Ellis | 37/260 |
| 3,760,517 A | | 9/1973 | Blaauw | |
| 3,828,450 A | | 8/1974 | Boeck | |
| 3,867,773 A | | 2/1975 | Gunderson | |
| 3,879,866 A | * | 4/1975 | Gunderson | 37/260 |
| 4,011,668 A | | 3/1977 | Gunderson | |
| 4,068,397 A | * | 1/1978 | Bacon | 37/260 |
| 4,150,501 A | * | 4/1979 | Hayashi | 37/246 |
| 4,205,468 A | | 6/1980 | Greider | |

(Continued)

FOREIGN PATENT DOCUMENTS

JP 2-190505 7/1990

OTHER PUBLICATIONS

Machinery's Handbook, 25th edition, 1996, International Press, Inc., pp. 2042-2043.*

(Continued)

*Primary Examiner*—Thomas A. Beach
(74) *Attorney, Agent, or Firm*—Michael Best & Friedrich LLP

(57) ABSTRACT

A snow thrower having a discharge chute rotation and locking device. The snow thrower includes a discharge chute rotatable about a chute axis with respect to the snow thrower housing to discharge in a selected direction snow under the influence of the auger. The snow thrower also includes a rod having a longitudinal axis non-parallel to the chute axis, the rod being rotatable about the longitudinal axis and movable axially along the longitudinal axis. The snow thrower further includes a first crank member fixed for rotation with the rod and engaging a portion of the chute to cause the chute to rotate in response to rotation of the rod. A locking member is movable into and out of engagement with the portion of the chute in response to axial movement of the rod. The chute is prevented from rotating under the influence of rotation of the rod when the locking member is moved into engagement with the portion of the chute.

16 Claims, 4 Drawing Sheets

U.S. PATENT DOCUMENTS

| | | | |
|---|---|---|---|
| 4,549,365 | A | 10/1985 | Johnson |
| 4,694,594 | A | 9/1987 | Thorud et al. |
| 4,862,607 | A | 9/1989 | Wacker |
| 5,315,771 | A | 5/1994 | White et al. |
| 5,438,770 | A | 8/1995 | Miller |
| 5,444,927 | A | 8/1995 | Sosenko |
| 5,735,064 | A | 4/1998 | Holl |
| 6,058,629 | A | 5/2000 | Peterson et al. |
| 6,327,798 | B1 | 12/2001 | Sakai et al. |
| 6,499,238 | B2 | 12/2002 | Kluck et al. |
| 6,622,464 | B2 | 9/2003 | Goman |
| 7,032,333 | B2 | 4/2006 | Friberg et al. |
| 2004/0255493 | A1 | 12/2004 | Friberg et al. |

OTHER PUBLICATIONS

ARIENS, GT Tractor Attachment Parts Manual, 831 Series, 1993, pp. 1-50, Part No. 030887, Ariens Company, U.S.A.

ARIENS, Sno-Thro Owner's & Parts Manual, 831 Series, Jul. 1998, pp. 1-24, Part No. 03084600B, Ariens Company, U.S.A.

ARIENS, Sno-Thro Parts Manual, 938 Series, Aug. 1997, pp. 1-11, #03808500B, Ariens Company, U.S.A.

Ariens/Gravely, Sno-Thro Owner/Operator & Parts Manual, Model 831045, Aug. 2003, pp. 1-21, #03098300D, Ariens Company and Gravely, a Division of Ariens Company, U.S.A.

* cited by examiner

SNOW THROWER DISCHARGE CHUTE

FIELD OF THE INVENTION

The present invention relates to snow throwers, and more particularly to discharge chutes for a snow thrower.

BACKGROUND OF THE INVENTION

Snow throwers are generally used to remove snow from a surface. Some snow throwers may include a discharge chute to direct the snow in a desired direction away from the snow thrower. The discharge chute may be rotatable to adjust the desired direction in which the snow is discharged.

SUMMARY OF THE INVENTION

The present invention provides a snow thrower having a frame supporting a housing; an auger at least partially disposed in the housing and adapted to move snow; and a discharge chute rotatable about a chute axis with respect to the housing to discharge snow in a selected direction under the influence of the auger. The snow thrower also includes a rod having a longitudinal axis non-parallel to the chute axis, the rod being rotatable about the longitudinal axis and movable axially along the longitudinal axis. The snow thrower further includes a first crank member fixed for rotation with the rod and engaging a portion of the chute to cause the chute to rotate in response to rotation of the rod; and a locking member movable into and out of engagement with the portion of the chute in response to axial movement of the rod. The chute is prevented from rotating under the influence of rotation of the rod when the locking member is moved into engagement with the portion of the chute.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

DETAILED DESCRIPTION

Figure 1:
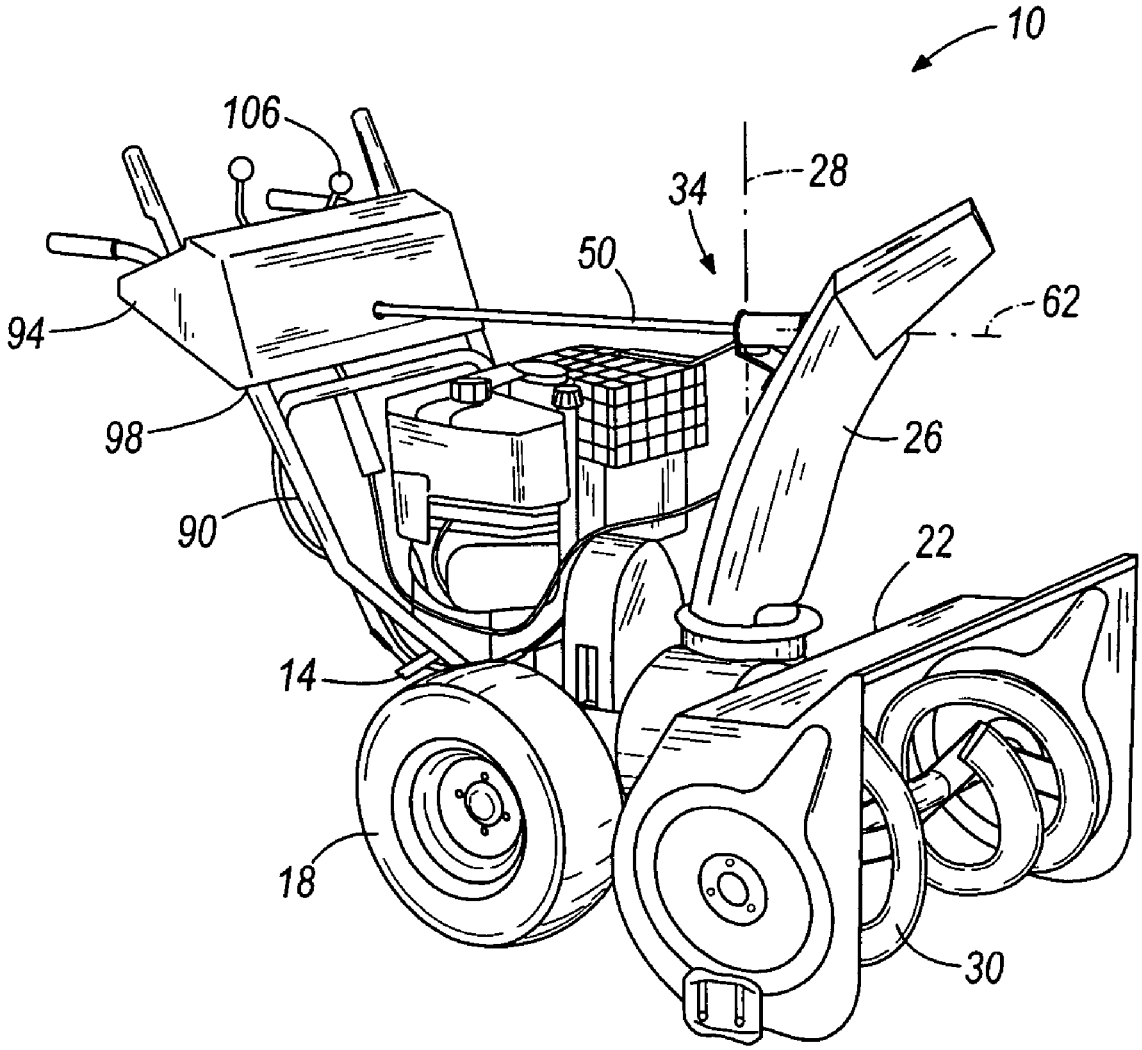
FIG. 1 is a perspective view of a snow thrower embodying aspects of the present invention.

FIG. 1 illustrates a snow thrower 10 having a frame 14 and wheels 18 supporting the frame 14. The frame 14 supports a housing 22 that at least partially encloses various components of the snow thrower 10. A discharge chute 26 is connected to the housing 22 for rotation with respect to the housing 22 about a chute axis of rotation 28. A primary auger 30 is at least partially disposed within the housing 22 and directs snow toward the discharge chute 26. A secondary auger (sometimes referred to as a "fan") is inside the housing rearward of the primary auger 30 and below the discharge chute 26 (making the illustrated snow thrower a so-called "two-stage" snow thrower). Snow is fed by the primary auger 30 to the secondary auger, and then expelled from the discharge chute 26 under the influence of the secondary auger. Other snow thrower constructions (i.e., "single-stage" snow throwers) use only one auger or fan, and the invention may be used with either type of snow thrower. The term "auger" as used herein, is intended to cover augers, fans, and any other means for moving and discharging snow through and from the snow thrower. The discharge chute 26 is rotatable to discharge snow from the snow thrower 10 at a desired angle (i.e., right, left, forward, or any angle in between) with respect to the housing 22.

Figure 3:
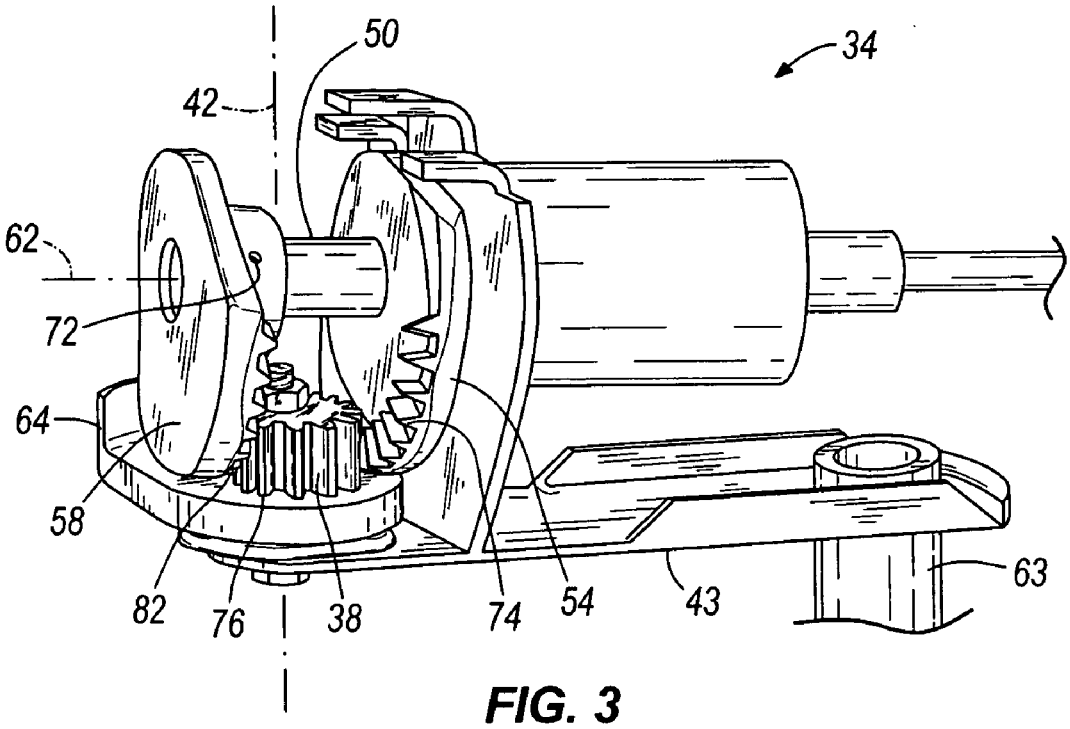
FIG. 3 is a perspective view of a control assembly of the snow thrower of FIG. 1.

With reference to FIG. 3, the snow thrower 10 includes a control assembly 34 to adjust the position of the discharge chute 26 with respect to the housing 22. The control assembly 34 permits the operator to quickly rotate the discharge chute 26 through the range of rotation. The control assembly 34 includes a gear 38 supported for rotation about an axis 42 on a bracket 43. The axis 42 is generally parallel to the axis of rotation 28 of the chute 26, and may be collinear with the chute axis 28. The control assembly 34 also includes a rod 50 and first and second crank members 54, 58 on the rod 50. The rod 50 has a longitudinal axis 62 generally perpendicular to the chute 26 and gear 38 axes of rotation 28, 42, and is supported by the bracket 43 for both rotational movement about the axis 62 and translational movement along the axis 62 (i.e., "axial" movement). As will be discussed in more detail below, both crank members 54, 58 are fixed for rotation with the rod 50, the rod 50 is permitted to move axially with respect to the first crank member 54, and the second crank member 58 is fixed for axial movement with the rod 50. The term "rod" includes the illustrated rigid elongated member and any other member that can be used to selectively rotate and axially move the crank members 54, 58.

The bracket 43 is mounted to the snow thrower frame 14 by way of a vertical mast 63 (partially shown in FIG. 3); the mast 63 and bracket 43 are fixed with respect to the frame 14 and housing 22. The gear 38 is mounted on or integral with an arm 64 such that the gear 38 and arm 64 are fixed for rotation with each other, and the arm 64 is affixed to the discharge chute 26. Thus, as will be discussed in more detail below, the rotation of the rod 50 causes rotation of the gear 38 and arm 64, which in turn causes the chute 26 to rotate.

Figure 4:
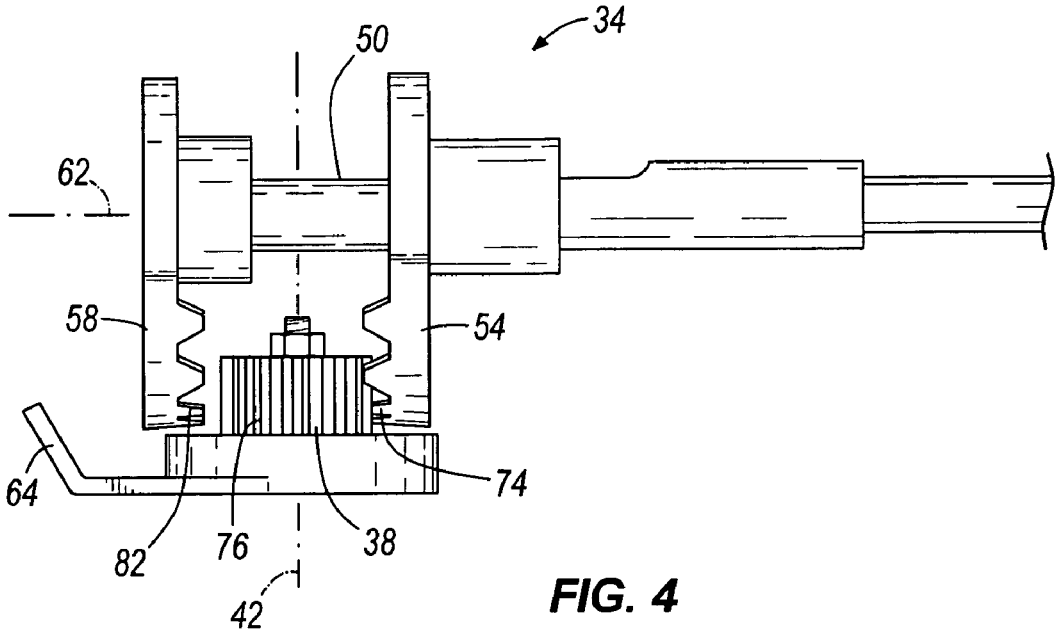
FIG. 4 is a side view of the control assembly of FIG. 3 illustrating the control assembly in an unlocked position.
Figure 7:
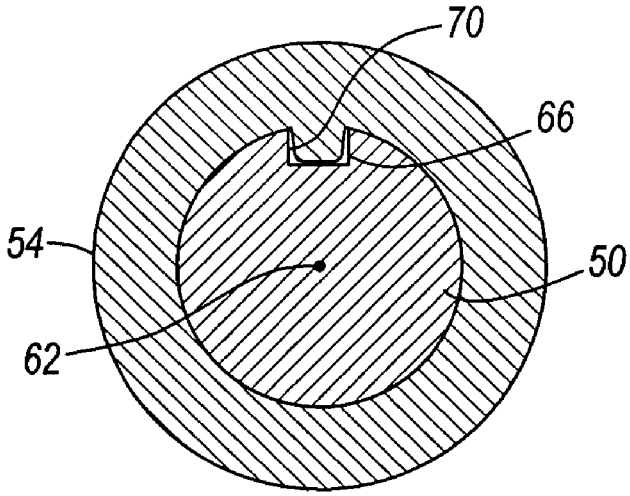
FIG. 7 is a cross-sectional view taken along line 7—7 of FIG. 5

With reference to FIG. 7, the rod 50 extends through the first crank member 54. The first crank member 54 is fixed for rotation with the rod 50 by way of an axially groove 66 in the rod 50 and a spline or ridge 70 on the first crank member 54. In alternative constructions, the groove 66 may be in the first crank member 54 and the ridge 70 may be on the rod 50. In other alternative constructions, the rod 50 and first crank member 54 may each have a groove or keyway, and they may be coupled for rotation by way of a key in the keyways. In other constructions, the rod 50 may have a non-circular cross section (for example, and without limitation, a polygon, oval, or D-shape cross section), and the first crank member 54 may have a through-hole that compliments the cross section of the rod 50 so that the rod 50 may not rotate with respect to the first crank member 54. The second crank member 58 is fixed for rotation with the rod 50 in a similar manner as discussed above with respect to the first crank member 54. Additionally, a set screw, pin, or other fastener is inserted through a hole 72 (see FIG. 3) in the second crank member 58 to fix the second crank member 58 on the rod 50, such that there is no relative axial movement between the second crank member 58 and the rod 50. In this regard, the second crank member 58 rides on the rod 50 and moves axially (i.e., left and right in FIGS. 3-5) with the rod 50.

The first crank member 54 includes teeth 74 that mesh with teeth 76 of the gear 38. The gear 38 and the bracket 43 restrict axial movement of the first crank member 54 such that the teeth 74, 76 are always in meshing engagement. The second crank member 58 includes teeth 82 that selectively engage the teeth 76 of the gear 38 when the rod 50 moves the second crank member 58 into engagement with the gear 38 (i.e., as in FIG. 5). Because both crank members 54, 58 are on the rod 50, and the rod axis 62 intersects the gear axis 42, the crank members 54, 58 engage diametrically-opposed sides of the gear 38 in the illustrated embodiment. In other embodiments, the axes 62, 42 may not intersect, and the crank members may engage the gear 38 to one side or the other. In such off-center arrangements, the crank members 54, 58 may be beveled to facilitate meshing engagement of their respective teeth 74, 82 with the teeth 76 of the gear 38.

Figure 5:
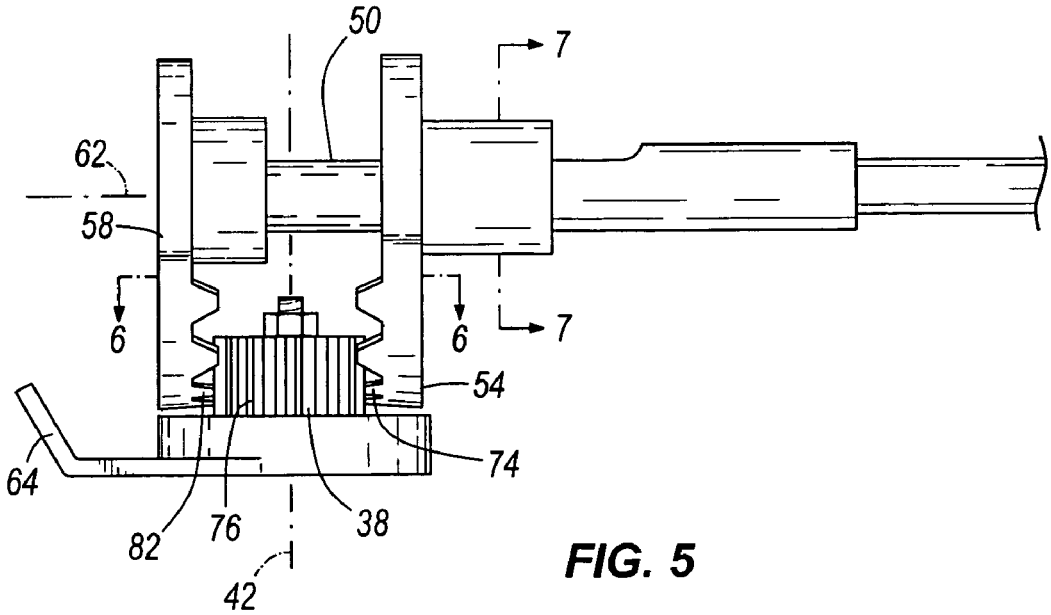
FIG. 5 is a side view of the control assembly of FIG. 3 illustrating the control assembly in a locked position.
Figure 6:
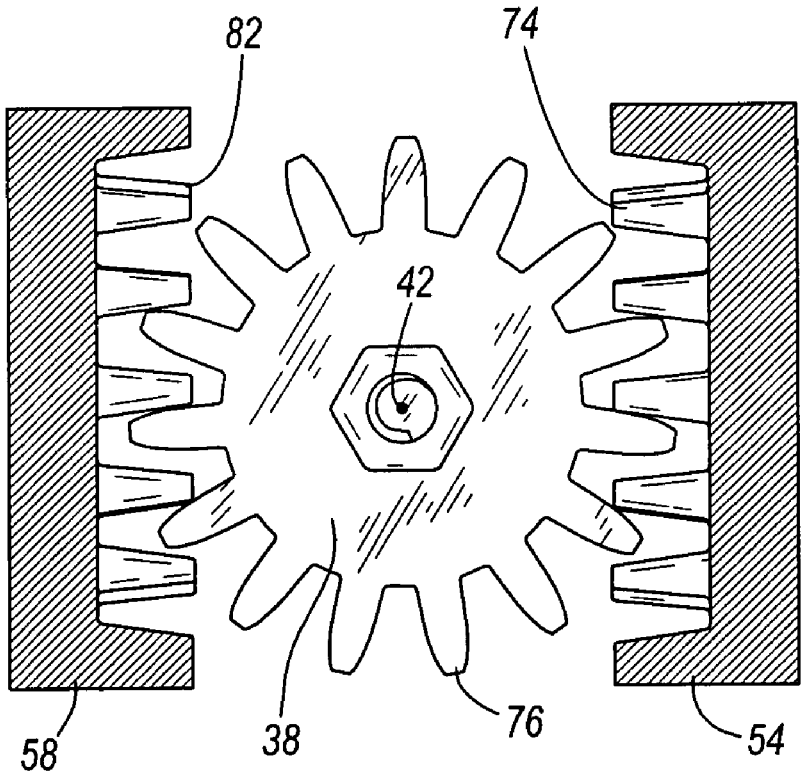
FIG. 6 is a partial cross-sectional view taken along line 6—6 of FIG. 5.

When the rod 50 is moved to the locked position illustrated in FIGS. 5 and 6, the teeth 74, 82 of both crank members 54, 58 mesh with the teeth 76 of the gear 38. Because both crank members 54, 58 are fixed for rotation with the rod 50, the gear 38 is prevented from rotating in either direction when the second crank member 58 is in the locked position. This is because the first and second crank members 54, 58 are urged by the gear 38 to rotate in opposite directions, but the rod 50 can only rotate in one direction at a time. However, when the second crank member 58 is in the unlocked position (FIG. 4), the gear 38 is only engaged by the first crank member 54 and rotates in response to rotation of the rod 50 and first crank member 54.

It should be noted that, although the illustrated construction utilizes a gear 38, first crank member 54, and second crank member 58 that are toothed, other types of rotation-transferring devices may be used, and the term "crank member" should be broadly construed to encompass any means for rotating the chute 26 in response to rotation of the rod 50. For example, friction plates, friction wheels, or other means for transferring the movement of one body to another may be used in place of the illustrated crank means 54, 58. Also, it is possible to lock the gear 38 without having the second crank member 58 fixed for rotation or axial movement with the rod 50. For example, the rod 50 may have, in other embodiments, stops that engage the second crank member after some axial movement of the rod 50 (i.e., there may be some axial "slop" in the connection between the rod 50 and the second crank member 58).

It is also possible to permit the rod 50 to rotate with respect to the second crank member 58, provided a stop is provided elsewhere (e.g., on the bracket 43) to prevent relative rotation of the second crank member 58 with respect to the gear 38 when in the locking position. For example, the second crank member 58 may slide into a fork or other structure when it is moved into the locked position so that the second crank member 58 is prevented from rotating (even though the rod and second crank member are not coupled for rotation together). It is also possible to provide a second crank member 58 with a single tooth or other member to engage the teeth of the gear 38 and the second crank member 58 does not need to be a toothed bell crank as illustrated. In other embodiments, the second crank member 58 may be in constant meshing engagement with the gear 38, and the rod may have a cross section that permits rotation of the second crank member 58 on the rod 50 when the rod is in the unlocked position, but that fixes the second crank member 58 for rotation with the rod 50 when the rod 50 is in the locked position.

With reference to FIG. 1, the snow thrower 10 includes a handle 90 extending upwardly from the housing 22. An operator control module 94 is disposed near an end 98 of the handle 90 opposite the housing 22, and facilitates control of the snow thrower 10. The rod 50 extends between the discharge chute 26 and the operator control module 94. The rod 50 includes a control end 102 (FIG. 2) disposed opposite the first and second crank members 54, 58 and near the operator control module 94. A lever 106 extends at a non-zero angle (approximately 90° in the illustrated embodiment) from the control end 102 of the rod 50 through the control module 94 and is in the operator zone. As used herein, the "operator zone" is the portion of the snow thrower accessible by the operator during ordinary operation of the snow thrower 10. The operator may manipulate the lever 106 to impart axial and rotational movement to the rod 50 during operation of the snow thrower 10.

Figure 2:
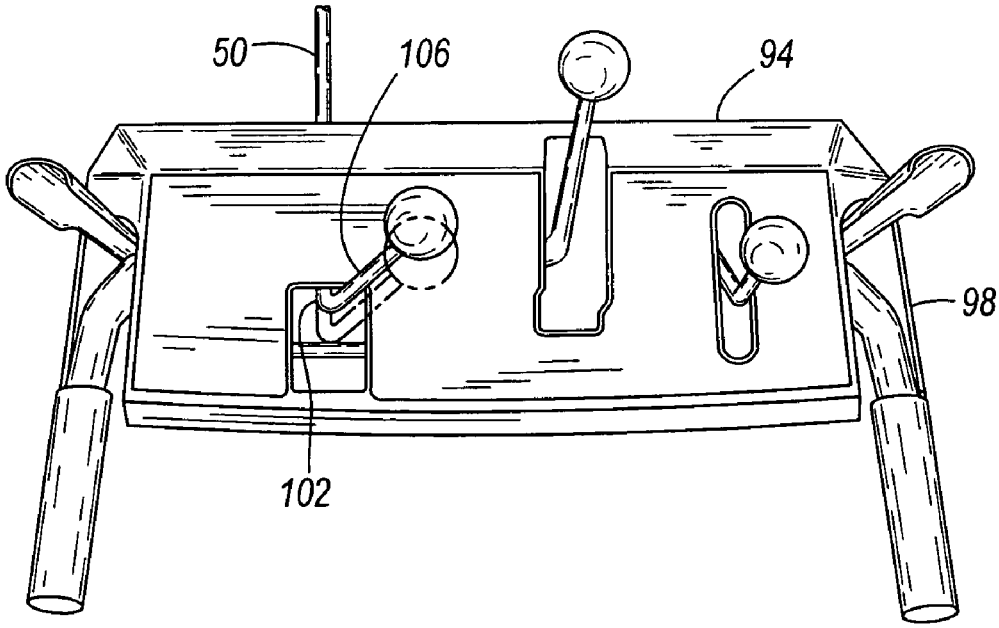
FIG. 2 is a perspective view of a portion of the snow thrower of FIG. 1.

For example, in the illustrated embodiment, moving the lever 106 forward and rearward moves the rod 50 between the locked and unlocked positions. In FIG. 2, the lever 106 is shown in the unlocked or forward position in solid lines (corresponding to the second crank member 58 being disengaged from the gear 38 as in FIG. 4). The lever 106 may be rotated to control rotation of the discharge chute 26 while in the unlocked position. The lever 106 is shown in the locked or rearward position in phantom (corresponding to the second crank member being engaged with the gear 38 as in FIG. 5).

When the lever 106 and control assembly 34 are in the unlocked position, the operator may quickly rotate the discharge chute 26 through the entire range of motion with a quick movement of the lever 106. Because the lever 106 is in the operator zone, the operator is not required to bend over to engage the lever 106 and adjust the discharge chute 26. Also, the control assembly 34 does not require multiple rotations or cranks of the rod 50 and lever 106. The lever 106 is restricted from rotating a full 360 degrees. Also, as shown in FIG. 1, the rod 50 may prevent the discharge chute 26 from rotating a full 360 degrees.

In the illustrated construction, the ratio of rotation of the discharge chute 26 to the lever 106 is approximately 1:1, or greater. For example, the angle of rotation of the discharge chute 26 will be about equal to or greater than the corresponding angle of rotation of the lever 106. The gear ratios of the gear 38 and first crank member 54 may be selected to obtain a desired ratio of rotation of the discharge chute 26 to the lever 106.

The invention claimed is:

1. A snow thrower comprising:

a frame supporting a housing;

an auger at least partially disposed in the housing and adapted to move snow;

a discharge chute rotatable about a chute axis with respect to the housing to direct in a selected direction snow that is moved under the influence of the auger;

a rod having a longitudinal axis non-parallel to the chute axis, the rod being rotatable about the longitudinal axis and movable axially along the longitudinal axis;

a first crank member fixed for rotation with the rod and engaging a portion of the chute to cause the chute to rotate in response to rotation of the rod; and a locking member movable into and out of engagement with the portion of the chute in response to axial movement of the rod, wherein the chute is prevented from rotating under the influence of rotation of the rod when the locking member is moved into engagement with the portion of the chute;

wherein the locking member includes a second crank member fixed for both rotation and axial movement with the rod.

2. The snow thrower of claim 1, wherein the portion of the chute engaged by the first crank member includes a gear fixed for rotation with the chute, and wherein the first crank member and the gear include teeth in meshing engagement.

3. The snow thrower of claim 1, wherein the first crank member includes a through-hole through which the rod extends.

4. The snow thrower of claim 3, wherein one of the first crank member and the rod includes a spline and the other of the first crank member and the rod includes a groove into which the spline is received to permit axial movement of the rod with respect to the first crank member while rotationally coupling the first crank member and the rod.

5. A snow thrower comprising:

a frame supporting a housing;

an auger at least partially disposed in the housing and adapted to move snow;

a discharge chute rotatable about a chute axis with respect to the housing to direct in a selected direction snow that is moved under the influence of the auger;

a rod having a longitudinal axis non-parallel to the chute axis, the rod being rotatable about the longitudinal axis and movable axially along the longitudinal axis;

a first crank member fixed for rotation with the rod and engaging a portion of the chute to cause the chute to rotate in response to rotation of the rod; and a locking member movable into and out of engagement with the portion of the chute in response to axial movement of the rod, wherein the chute is prevented from rotating under the influence of rotation of the rod when the locking member is moved into engagement with the portion of the chute;

wherein the portion of the chute engaged by the first crank member includes a gear fixed for rotation with the chute, wherein the locking member includes a second crank member fixed for both rotation and axial movement with the rod, wherein the gear and first and second crank members include teeth, wherein the first crank member and the gear are in meshing engagement, wherein the second crank member is moveable into and out of meshing engagement with the gear in response to axial movement of the rod, wherein the chute rotates with respect to the housing under the influence of the rod and first crank member when the second crank member is not engaged with the gear, and wherein the chute is prevented from rotating with respect to the housing when both the first and second crank members are in meshing engagement with the gear.

6. The snow thrower of claim 1, wherein the rod longitudinal axis is generally perpendicular to the chute axis.

7. The snow thrower of claim 1, further comprising a handle connected at a non-zero angle to the rod, the handle being in the operator zone of the snow thrower such that axial and rotational movement of the rod is controlled trough to handle from the operator zone.

8. The snow thrower of claim 1, what the ratio of rotation of the chute to rotation often rod is at least 1:1.

9. A snow thrower comprising:

a frame supporting a housing;

an auger at least partially disposed in the housing and adapted to move snow;

a discharge chute rotatable about a chute axis with respect to the housing to direct in a selected direction snow that is moved under the influence of the auger;

a gear mounted to and fixed for rotation with the discharge chute;

a rod supported by the housing for rotational and axial movement;

a first crank member fixed to the rod for rotation therewith, but permitting axial movement of the rod with respect to the first crank member; and a second crank member fixed to the rod for both rotational and axial movement with the rod, the second crank member being selectively engageable and disengagable from the gear in response to axial movement of the rod;

wherein the discharge chute is rotatable in response to rotation of the rod when the first crank member is engaged with the gear and the second crank member is disengaged with the gear; and wherein the discharge chute is locked against rotation when the second crank member is engaged with the gear.

10. The snow thrower of claim 9, wherein the first and second crank members are on substantially diametrically-opposed sides of the gear.

11. The snow thrower of claim 9, wherein the first crank member is connected to the rod with a splined connection.

12. The snow thrower of claim 9, further comprising: an operator zone in which the operator is positioned during normal operation of the snow thrower; and a lever in the operator zone and connected to the rod such that the rod may be rotationally and axially manipulated through the lever from the operator zone.

13. The snow thrower of claim 9, wherein the ratio of rotation of the gear with respect to the rod is at least 1:1.

14. A snow thrower comprising:

a frame supporting a housing;

an auger at least partially disposed in the housing and adapted to move snow;

a discharge chute rotatable about a chute axis with respect to the housing to direct in a selected direction snow that is moved under the influence of the auger;

a rod extending between an operator zone in which the operator is positioned during normal operation of the snow thrower, and the discharge chute, the rod having a longitudinal axis;

means for rotating and axially moving the rod with respect to the longitudinal axis;

means for rotating the discharge chute in response to rotation of the rod when the rod is moved to a first axial position; and means for preventing rotation of the rod and discharge chute when the rod is moved to a second axial position;

wherein the means for rotating includes a gear fixed to the discharge chute for rotation therewith, and a first toothed crank member fixed for rotation with the rod in meshing engagement with the gear; and wherein the means for preventing rotation includes a second toothed crank member fixed for both rotation and axial movement with the rod, wherein the first toothed crank member permits axial movement of the rod with respect to the first toothed crank member, and wherein the rod is movable axially to engage the gear with the second toothed crank member to prevent rotation of the rod and discharge chute.

15. The snow thrower of claim 14, wherein the longitudinal axis of the rod and the axis of rotation of the discharge chute are generally perpendicular to each other.

16. The snow thrower of claim 14, wherein the first and second crank members engage diametrically-opposed sides of the gear.

* * * * *